US005219474A

United States Patent [19]

Song et al.

[11] Patent Number: 5,219,474

[45] Date of Patent: Jun. 15, 1993

[54] LIQUID FIRE EXTINGUISHING COMPOSITION

[75] Inventors: Choong E. Song; In O. Kim; Jae K. Lee; Tae K. Kim; Sang G. Lee, all of Seoul, Rep. of Korea

[73] Assignee: Korea Institute of Science and Technology, Seoul, Rep. of Korea

[21] Appl. No.: 564,192

[22] Filed: Aug. 8, 1990

[30] Foreign Application Priority Data

Nov. 17, 1989 [KR] Rep. of Korea ..... 16719/1989

[51] Int. Cl.[5] ..... A62D 1/00; A62D 1/08

[52] U.S. Cl. ..... 252/8; 252/2; 252/3

[58] Field of Search ..... 252/2, 3, 8

[56] References Cited

U.S. PATENT DOCUMENTS

| | | | |
|---|---|---|---|
| 4,054,543 | 10/1977 | Batorewicz | 260/45.95 |
| 4,226,728 | 10/1980 | Kung | 252/8 |
| 4,287,307 | 9/1981 | Hostettler | 521/51 |
| 4,459,213 | 7/1984 | Uchida et al. | 252/2 |
| 4,565,833 | 1/1986 | Buszard et al. | 252/609 |
| 4,606,832 | 8/1986 | Hisamoto et al. | 252/8 |
| 4,668,407 | 5/1987 | Gerard et al. | 252/8 |

*Primary Examiner*—Robert L. Stoll
*Assistant Examiner*—Joseph D. Anthony
*Attorney, Agent, or Firm*—Birch, Stewart, Kolasch & Birch

[57] ABSTRACT

A liquid fire extinguishing composition is obtained by mixing a $C_1$-$C_5$ halogenated alkane such as Halone 1301 ($CF_3Br$), Halone 1211 ($CF_2ClBr$), or a mixture thereof with an organophosphorus compound, or the mixture thereof for a wide variety of a fire extinguishment and no residues after fire extinguishing.

4 Claims, No Drawings

LIQUID FIRE EXTINGUISHING COMPOSITION

BACKGROUND OF THE INVENTION

1. Field of the Invention

The present invention relates to a liquid fire extinguishing composition useful for a wide variety of a fire extinguishment. More particularly, the present invention is directed to effective liquid fire extinguishing compositions which are obtained by mixing a halogenated alkane such as Halone 1301 ($CF_3Br$), Halone 1211 ($CF_2ClBr$), or a mixture thereof with an organophosphorus compound or the mixture thereof in an appropriate ratio.

2. Description of the Prior Art

Various types of fire extinguishing compositions are well known in the art. Such fire extinguishing compositions include foam extinguishants, dry powder extinguishing agents based on monoammonium phosphate and vaporizing liquid fire extinguisher based on halogenated alkanes.

Such foam extinguishants which extinguish a fire by applying foam to prevent oxygen from supplying from air together with cooling by water. They have advantages in that their cost are cheap and they can be used in case of a conflagration. However, they have disadvantages in that they require a great deal of water to produce foam so that they are not suitable for portability and Class C fire such as a fire caused by electricity.

Such powder extinguishers based on monoammonium phosphate, sodium bicarbonate, potassium bicarbonate, etc. are thermally decomposed to produce ammonia, carbon dioxide, and water. Ammonia and carbon dioxide formed therefrom dilute concentration of oxygen in air or prevent oxygen from supplying from air while water formed therefrom undergoes cooling to extinguish flames. In addition, anhydrous substances are usually fused to be adhered as a coating on the surface of burning materials, which eventually prevent effectively from contacting with air to accelerate fire extinguishment. One of such powder extinguishers, ABC powder extinguisher based monoammonium phosphate has wide effective applications in a fire caused by electricity or oils including a usual fire caused by woods. However, they have disadvantages in terms of solidification and quality deterioration etc. caused by hygroscopicity during long-term storage and bulky extinguishing appliance. Another problem in foam extinguisher and powder extinguisher lies in the fact that they leave dirty traces behind in the wake of fire extinguishment. These problems provide a vital defect in case of fire extinguishing of expensive fine quality goods.

Other types of fire extinguishing material include, for example, vaporizing nonaqueous liquid fire extinguishers based on halogenated aliphatic hydrocarbons which are decomposed by flames to terminate continuous combustion reactions. These Halone extinguishers have advantages in that they provide a clean environment after fire extinguishing. However, they are relatively expensive and high volatility. Furthermore, they give more ineffective situations than powder extinguishers against surface fires of solid combustible material (A-Class fire).

SUMMARY OF THE INVENTION

Accordingly, it is an object of the present invention to provide an improved fire extinguishing composition to eliminate problems described heretofore.

Another object of the present invention is to provide a fire extinguishing composition which comprises from 35% to 99.9% by weight of one or more fire-extinguishing $C_1$–$C_5$ halogenated alkanes and from 0.1% to 65% by weight of one or more organophosphorus compounds and optionally adding from 0.1% to 30% by weight of one or more appropriate solvents when both components are insoluble each other.

Other objects and further scope of applicability of the present invention will become apparent form the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a liquid fire extinguishing composition is obtained by mixing a $C_1$–$C_5$ halogenated alkane such as Halone 1301 ($CF_3Br$), Halone 1211 ($CF_2ClBr$), or a mixture thereof with an organophosphorus compound, or the mixture thereof for a wide variety of a fire extinguishment and no residues after fire extinguishing.

DESCRIPTION OF THE PREFERRED EMBODIMENTS

The liquid fire extinguishing composition according to the present invention does not leave residues after fire extinguishing and is surprisingly effective in its fire extinguishing capability when compared with conventional Halone extinguishers and powder extinguishers based on monoammonium phosphate in every fire extinguishment.

$C_1$–$C_5$ halogenated alkanes used in the present invention include, for example, bromotrifluoromethane, bromochlorodifluoromethane, dibromodifluoromethane, dichlorodifluoromethane, trichlorofluoromethane, chlorobromomethane, chloropentafluoroethane, 1,2-dibromotetrafluoroethane, 1,2-dibromotrifluoroethane, 1,2-dibromoethane, 2-bromo-2-chloro-1,1,1-trifluoroethane, 1,1,2-trichlorotrifluoroethane,1,2-dibromohexafluoropropane and3-bromo-1,1,1-trifluoropropane.

The organic phosphorous compounds used in the compositions of the present invention have the following formula (I) and (II):

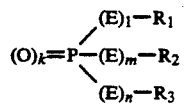

(I)

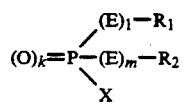

(II)

wherein

E represents oxygen or sulfur, k, l, m, and n are zero or 1

$R_1$, $R_2$, and $R_3$ are independently $C_1$–$C_{18}$ alkyl, $C_1$–$C_{18}$ alkyl substituted with halogen and/or amino group, $C_6$–$C_{12}$ aryl, $C_6$–$C_{12}$ aryl substituted with halogen and/or amino group, or a group represented by the formula:

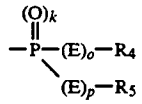

wherein k, o, and p represent zero or one, and $R_4$ and $R_5$ are the same as defined in $R_1$, $R_2$ and $R_3$, and X is hydrogen or halogen.

Furthermore, in case that halogenated alkane and organophosphorus compound used in mixing those fire extinguishing compositions are insoluble each other or have low solubility, proper solvents, for example, $C_1$–$C_5$ halogenated alkane composition, $C_5$–$C_8$ aliphatic hydrocarbon, $C_6$–$C_8$ aromatic hydrocarbon, $C_3$–$C_6$ carbonyl compound, $C_4$–$C_6$ aliphatic ether, and $C_1$–$C_5$ alcoholic compound are used. When the injection pressure within the vessel is below 14 kg/cm$^2$, compressed gas of nitrogen, argon, or carbon dioxide gas is also used.

In particular, the composition showing excellent fire extinguishing effect is a mixture comprising from 35% to 99.9% by weight of one or more $C_1$–$C_5$ halogenated alkanes, from 0.1% to 65% by weight of one or more organophosphorus compounds and optionally from 0.1% to 30% by weight of a solvent is desired. In such a case, a mixture of halogenated alkanes contains 70% to 100% by weight of bromotrifluoromethane, or chlorobromodifluoromethane, or a mixture thereof.

A mixture of organophosphorus compounds contains 50% by weight of the compound of the formula (I) such as trialkyl phosphate, triaryl phosphate, trihalogenated alkyl phosphate, alkyl phosphorate, aryl phosphorate, and halogenated alkyl phosphorate, or a mixture thereof.

Solvent used in the present invention contains 50% to 100% by weight of a halogenated alkane compound such as dichloromethane, chloroform, bromoform, chlorodifluoromethane, dichlorofluoromethane, carbon tetrachloride, 1,2-dibromomethane, 1,2-dichloroethane, trichloroethylene, bromoethane, or hexachloroethane, provided that halogenated alkanes used as fire extinguishing agent are excluded.

The compositions comprising ingredients defined as above do not leave residues after fire extinguishing and present excellent fire extinguishment. That is, it is three times more stronger than conventional Halone extinguishers (80% by weight of Halone 1301) in a fire extinguishing test for a fire caused by oil (Class B) and three times more stronger than conventional Halone extinguisher 1211 in a fire extinguishing test for a usual fire (Class A), respectively.

As a result, the fire extinguishing composition according to the present invention shows a powerful extinguishing effect in order to reduce remarkably the amount of Halone required as well as toxicity and corrosiveness of the fire extinguishing composition when compared with conventional Halone extinguishers.

In addition, the fire extinguishing composition of the present invention presents remarkable slower vaporization when compared with conventional Halone extinguishers so that the fire extinguishment distant from the flames is possible.

The present invention will be illustrated in terms of fire extinguishing capability of the fire extinguishing compositions of the present invention by the following example.

EXAMPLE

The fire extinguishing composition was prepared by charging into a stainless steel pressure vessel. That is, 1 kg of a mixture of an organophosphorus compound and an alkane compound and nitrogen gas was filled therein with a pressure of 14 kg/cm$^2$ if desired.

Each composition of the ingredients used is shown in Table 1.

TABLE 1

| Sample | Composition Ratio of Fire Extinguishing Compositions |
|---|---|
| 1. | MAP[a] |
| 2. | (1301)[b] 200 g + (1211)[c] 800 g |
| 3. | (1301) 690 g + (1211) 98 g + trimethyl phosphate 120 g + solvent 92 g |
| 4. | (1301) 600 G + (1211) 135 g + triethyl phosphate 120 g + solvent 145 g |
| 5. | (1301) 284 g + (1211) 425 g + tributyl phosphate 180 g + solvent 111 g |
| 6. | (1301) 605 g + (1211) 110 g + triphenyl phosphate 210 g + solvent 75 g |
| 7. | (1301) 631 g + (1211) 85 g + tritolyl phosphate 200 g + solvent 84 g |
| 8. | (1301) 684 g + (1211) 121 g + tricresyl phosphate 120 g + solvent 75 g |
| 9. | (1301) 630 g + (1211) 105 g + tris(2-chloroethyl) phosphate 180 g + solvent 85 g |
| 10. | (1301) 675 g + (1211) 115 g + tris(dichloropropyl) phosphate 120 g) + solvent 90 g |
| 11. | (1301) 711 g + (1211) 95 g + tris(2,3-dibromopropyl) phosphate 100 g + solvent 94 g |
| 12. | (1301) 730 g + (1211) 84 g + bis(2-chloroethyl)-2-chloroethyl phosphorate 120 g + solvent 66 g |
| 13. | (1301) 675 g + (1211) 92 g + tris(tribromophenyl) phosphate 120 g + solvent 113 g |
| 14. | (1301) 690 g + (1211) 92 g + trimethyl phosphate 100 g + tris(2-chloroethyl) phosphate 36 g + solvent 82 g |
| 15. | (1301) 605 g + (1211) 101 g + 1,2-dibromotetrafluoroethane 50 g + tributyl phosphate 77 g + tris(dichloropropyl) phosphate 64 g + solvent 103 g |
| 16. | (1301) 658 g + (1211) 145 g + bis(2,3-dibromopropyl)-2,3-dibromopropyl phosphorate 103 g + solvent 94 g |
| 17. | (1301) 624 g + (1211) 152 g + triethyl phosphate 44 g trimethyl phosphate 75 g + solvent 105 g |

Note:
[a](MAP) = monoammonium phosphate
[b](1301) = Halone 1301
[c](1211) = Halone 1211

Fire extinguishing test for a fire cause by oil was conducted in accordance with No. 1 Model of Class B specified in Article 28 of Decree of the Ministry of Home Affairs of the Republic of Korea wherein fire extinguishing composition was jetted two meters distant from the flames through a 3 mm injection nozzle. Time and amount of fire extinguishing composition consumed to extinguish the fire were measured.

Fire extinguishing capability of the composition of the present invention as shown in Table 1 and conventional fire extinguishers based on monoammonium phosphate (ABC powder fire extinguisher) and Halone (Halone 1211 80% +Halone 1301 20%) were compared. The results obtained are given in Table 2.

TABLE 2

| Fire Extinguishing Test for Class B Fire | | |
|---|---|---|
| Sample | Fire Extinguishing Time (Second) | Amount Consumed (g) |
| 1 | 5.0 | 700 |
| 2 | 5.1 | 720 |
| 3 | 3.3 | 290 |
| 4 | 4.0 | 330 |
| 5 | 3.1 | 310 |
| 6 | 5.0 | 350 |
| 7 | 3.5 | 280 |
| 8 | 3.1 | 320 |
| 9 | 3.0 | 300 |
| 10 | 3.7 | 330 |
| 11 | 3.0 | 280 |
| 12 | 4.8 | 450 |
| 13 | 3.9 | 410 |
| 14 | 3.4 | 310 |
| 15 | 3.9 | 340 |
| 16 | 3.6 | 320 |
| 17 | 4.0 | 340 |

TABLE 3

| Fire Extinguishing Test for Class A Fire | | |
|---|---|---|
| Sample | Fire Extinguishing Time (Second) | Amount Consumed (g) |
| 1 | 9 | 740 |
| 2 (1211) | 12-3 | 3000 |
| 5 | 11 | 940 |
| 6 | 10 | 890 |
| 7 | 12 | 980 |
| 9 | 11 | 910 |

Samples 1 to 2 in Tables 1 and 2 are conventional fire extinguishers which show longer fire extinguishing time and more amount consumed compared with fire extinguishing compositions of the present invention.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A fire extinguishing composition consisting essentially of:

(1) about 35-99.9% by weight of halogenated alkane selected from the group consisting of bromochlorodifluoromethane, bromotrifluoromethane, and mixtures thereof;

(2) about 0.1-65% of an organophosphorus compound represented by the following formula (I) or (II)

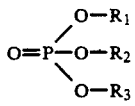

(I)

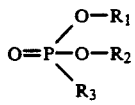

(II)

wherein $R_1$, $R_2$ and $R_3$ are independently $C_1$-$C_6$ alkyl group, $C_1$-$C_6$ alkyl group substituted with halogen, or $C_6$-$C_{12}$ aryl group; and (3) compressed gas.

2. The fire extinguishing composition of claim 1 further comprising about 0.1-30% by weight of a solvent when said two component composition is insoluble.

3. The fire extinguishing composition of claim 2 wherein said solvent is selected form the group consisting of dichloromethane, chloroform, bromoform, carbontetrachloride, chlorodifluoromethane, dichlorofluoromethane, 1,2-dibromoethane, 1,2-dichloroethane, trichloroethane, trichloroethylene, and bromoethane.

4. A fire extinguishing composition consisting essentially of:

(1) about 35-99.9% by weight of halogenated alkane selected from the group consisting of bromochlorodifluoromethane, bromotrifluoromethane, and mixtures thereof;

(2) about 0.1-65% by weight of an organophosphorus compound represented by the following formula (I) or (II)

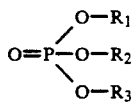

(I)

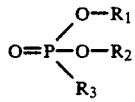

(II)

wherein $R_1$, $R_2$ and $R_3$ are independently $C_1$-$C_6$ alkyl group, $C_1$-$C_6$ alkyl group substituted with halogen, or $C_6$-$C_{12}$ aryl group; and (3) about 0.1-30% by weight of a solvent.

* * * * *